United States Patent [19]

Urban et al.

[11] Patent Number: 4,610,776

[45] Date of Patent: Sep. 9, 1986

[54] COAL LIQUEFACTION PROCESS

[75] Inventors: Peter Urban, Northbrook; Lee Hilfman, Mount Prospect, both of Ill.

[73] Assignee: UOP Inc., Des Plaines, Ill.

[21] Appl. No.: 754,718

[22] Filed: Jul. 15, 1985

Related U.S. Application Data

[63] Continuation-in-part of Ser. No. 626,810, Jun. 29, 1984, abandoned.

[51] Int. Cl.[4] ..... C10G 1/06; C10G 1/00; C10G 47/02; C10G 11/00

[52] U.S. Cl. ..... 208/418; 208/941; 208/420; 208/108; 208/113; 208/431; 208/951

[58] Field of Search ..... 208/9, 19, 11 R, 108, 208/113

[56] References Cited

U.S. PATENT DOCUMENTS

| | | | |
|---|---|---|---|
| B 700,485 | 4/1969 | Hemminger et al. | 208/8 LE |
| B 700,489 | 4/1969 | Long et al. | 208/8 LE |
| 1,467,758 | 9/1923 | Day | 208/11 R |
| 2,489,702 | 11/1949 | Coast | 208/11 R |
| 2,905,595 | 9/1979 | Berg | 208/11 R |
| 3,567,622 | 3/1971 | Waltrip | 208/11 R |
| 3,577,338 | 5/1971 | Gifford | 208/11 R |
| 3,607,717 | 9/1971 | Roach | 208/8 LE |
| 3,617,471 | 11/1971 | Schlinger | 208/11 R |
| 3,929,193 | 12/1975 | Duke | 208/8 LE |
| 3,966,583 | 6/1976 | Cramer | 208/11 R |
| 4,001,105 | 1/1977 | Gifford | 208/11 R |
| 4,028,220 | 6/1977 | Urquhart | 208/8 LE |
| 4,314,899 | 2/1982 | Styring, Jr. | 208/11 R |
| 4,324,643 | 4/1982 | Durai-Swamy | 208/11 R |
| 4,388,171 | 6/1983 | Beggs et al. | 208/8 LE |
| 4,438,816 | 3/1984 | Urban et al. | 166/303 |
| 4,443,321 | 4/1984 | Compton | 208/10 X |
| 4,447,310 | 5/1984 | Derbyshire et al. | 208/8 LE |
| 4,448,669 | 5/1984 | Scinta | 208/11 LE |
| 4,461,696 | 7/1984 | Bock et al. | 208/11 LE |

*Primary Examiner*—Andrew H. Metz
*Assistant Examiner*—William G. Wright
*Attorney, Agent, or Firm*—Thomas K. McBride; John F. Spears, Jr.; Thomas J. Filarski

[57] ABSTRACT

A coal liquefaction process comprising reacting coal with a hydrocarbonaceous solvent at coal liquefaction conditions in the presence of an oil shale residue catalyst comprising organic and inorganic fractions. The oil shale residue catalyst is derived by heating an oil shale in the presence of an inert gas with respect to the oil shale at a temperature of 500°-825° F.

17 Claims, No Drawings

COAL LIQUEFACTION PROCESS

CROSS-REFERENCE TO RELATED APPLICATION

This application is a continuation-in-part of prior copending application Ser. No. 626,810 filed on June 29, 1984, now abandoned. The teaching of said prior application is incorporated herein by reference.

BACKGROUND OF THE INVENTION

The field of art to which this invention pertains is coal liquefaction. More specifically, the invention relates to an improved process for the liquefaction of coal utilizing an oil shale residue catalyst comprising an organic and inorganic fraction.

In an effort to provide an economically commercial process for the liquefaction of coal, literally hundreds of processes have been proposed, each of which offers a somewhat different choice and/or combination of the many possible operating conditions and apparatus.

One problem with many prior art processes is that the quality and quantity of the coal derived hydrocarbon liquids have been inferior. This impediment is believed to be at least partly due to the fact that a suitable and economic means of promoting the coal liquefaction reaction via catalyst has not been available.

In U.S. Pat. No. 4,001,105 (Gifford II), a process is disclosed which produces hydrocarbonaceous products from carbonaceous materials, including coal, utilizing a catalyst which is derived from either raw oil shale or spent oil shale by activating the shale in the presence of steam at a temperature in the range of about 1000° F. to about 1600° F. At these conditions the oil shale becomes activated via at least partial decomposition of inorganic carbonates found therein. Moreover, at activation temperatures above 1000° F., organic fractions present in the oil shale are also decomposed.

Defensive Publication No. 700,489 (Long et al.) discloses the extraction of ground oil shale or a retorted shale in the presence of a solvent at supercritical conditions which include a temperature in the range of 90°-500° F. and a pressure in the range of 750-5000 psig. The spent shale produced at these conditions is discarded from the process.

In U.S. Pat. No. 3,929,193 (Duke) organic matter is recovered from organic mineral-containing deposits such as oil shale by contacting the shale at a temperature range of 200° to 1000° F. with an extraction fluid and elemental sulfur. Extraction of the organic matter may be carried out either above ground after first mining the shale or "in situ" by injecting the extraction fluid and elemental sulfur into the organic mineral-containing deposit. Patentee does not teach any use for the extracted shale residue.

Finally, U.S. Pat. No. 4,438,816 (Urban et al.) teaches a process for the recovery of hydrocarbonaceous oil from oil shale. The process comprises heating the shale in the presence of a non-combustion supporting, non oil-miscible gas at a temperature range of about 650° F. to 825° F. to produce a material which is more readily conducive to the maximum recovery of the hydrocarbonaceous oil contained therein. The resulting treated shale is then solvent extracted with a normally liquid solvent at subcritical, reflux conditions to liberate any remaining organic hydrocarbonaceous fractions.

It is therefore an object of this invention to provide an improved coal liquefaction process. It is further an object of this invention to provide for an improved coal liquefaction process by employing an improved catalyst for use therein. Finally, it is also an object of this invention to provide for an improved coal liquefaction catalyst which comprises a pretreated oil shale residue.

SUMMARY OF THE INVENTION

In accordance with the present invention a coal liquefaction process comprising reacting coal with a hydrocarbonaceous solvent at coal liquefaction conditions in the presence of an oil shale residue catalyst comprising organic and inorganic fractions has now been discovered.

A second embodiment of the present invention comprises a coal liquefaction process comprising reacting coal with a hydrocarbonaceous solvent at coal liquefaction conditions in the presence of an oil shale residue catalyst comprising organic and inorganic fractions wherein said oil shale residue catalyst is derived by pretreating an oil shale in the presence of an inert gas at pretreatment conditions sufficient to produce a hydrocarbon fraction and an oil shale residue catalyst comprising organic and inorganic fractions.

Further objects and embodiments of the invention including details about coal feeds, oil shales, process schemes and operating conditions will be obvious to one skilled in the art in view of the following discussion.

DETAILED DESCRIPTION OF THE INVENTION

The present invention is concerned with a process for the liquefaction of coal utilizing an oil shale residue catalyst comprising organic and inorganic fractions. The oil shale residue catalyst is prepared by heating an oil shale in the presence of an inert gas.

The term "inert gas" as used herein imports any gas which does not substantially react with an oil shale at the contemplated pretreatment conditions and when in admixture with an oil shale at said pretreatment conditions results in the production of an oil shale residue comprising organic and inorganic fractions. Though not intending to be limited in any manner, preferred inert gases are nitrogen, hydrogen sulfide, ammonia, mercaptan hydrocarbon, sulfur dioxide, carbon monoxide, carbon dioxide, water and mixtures thereof. Especially preferred inert gases are nitrogen, hydrogen sulfide and mixtures thereof.

The oil shales (hereinafter "shale") contemplated in the present invention are found in deposits occurring in many countries of the world. The shales of the Green River formation in Colorado, Utah and Wyoming are among the most significant and illustrate the many varied deposits in the United States. Oil shale also occurs in at least twenty-eight states, including Idaho, Illinois, Indiana, Kansas, Michigan, Arkansas, Nevada, New York, New Mexico, Ohio, Oklahoma, Pennsylvania, Tennessee and Texas. Although the present invention is generally suited for all types of oil shale, Green River (or Western) shale oil is a preferred oil shale. Shale is sedimentary rock with a relatively high organic content. The organic matter, or kerogen, of the shale is believed to exist between particles of inorganic matter, and some portion thereof may be directly or chemically bonded to mineral constituents. The inability of the usual organic solvents to remove kerogen from shale directly and the failure of usual ore-dressing techniques (sink-float) to result in appreciable enrichment in organic matter is believed to indicate that most of the kerogen is held to the inorganic matter of the shale by bonds stronger than mere physical adsorption.

It has now been discovered that when oil shale is pretreated with an inert gas at a temperature of about 500° F. to about 825° F. and a pressure of from atmospheric to about 2000 psig for a period of from about 0.1 to 10 hours, an oil shale residue comprising organic and inorganic fractions and having a catalytic effect for the liquefaction of coal is produced. The pretreatment of the shale with an inert gas need not be conducted at exceedingly high pressures. In fact, the only pressure required is that which will cause a blanket of inert gas to be maintained on the shale. The process of the present invention, therefore, is preferably conducted at a pressure of from atmospheric to about 500 psig and most preferably at a pressure of about atmospheric to about 100 psig. The temperature may vary in accordance with the one or more different types of shale and inert gas employed. Preferred temperatures include temperatures within the range of about 600° F. to 750° F.

The term "oil shale residue" is meant to describe a shale-derived material which, after being subjected to the above described pretreatment conditions, comprises organic and inorganic fractions. Without being limited to theoretical concepts, it is believed that the organic fraction comprises sulfurous and nitrogenous organic based materials. This organic matter remains in contact with the inorganic matter of the shale through bonds believed to be stronger than mere physical adsorption. It is this unique combination of organic and inorganic matter which is believed to be responsible for the catalytic effect imparted by the oil shale residue. Regardless of how and why the organic and inorganic fractions interact with each other and the coal, in order to impart a catalytic effect in the conversion of coal to liquid hydrocarbons, it is essential that the oil shale residue catalyst comprises both organic and inorganic fractions.

The oil shale residue produced by the pretreatement process is generally a friable material. The term "friable" is meant to conform to the traditional definition known in the art and describes a material which is easily crumbled or pulverized. It is believed that the friable nature of the oil shale residue catalyst is particularly advantageous to a coal liquefaction process. It has been observed that upon mechanical agitation the oil shale residue readily converts to a sludge and, when in the presence of an aromatic solvent, swells, expands and becomes distended. Without being limited to theory, it is contemplated that these observed properties are important to the catalytic activity imparted by the oil shale residue. It is believed that the friable character contributes to an increased particle surface area and, when in the presence of an aromatic solvent, swelling causes the particles to fracture further increasing their surface area. The oil shale residue utilized in the present coal liquefaction process is preferably reduced in size to an average particle diameter equivalent to at least a −10 Tyler Screen Size and may be reduced in size either before or after the shale is pretreated.

In addition to producing an oil shale residue, the pretreatment step also causes the liberation of hydrocarbonaceous oil from the raw shale. The production of a hydrocarbon fraction from shale when subjected to the above-mentioned pretreatment conditions has been taught in U.S. Pat. No. 4,438,816, the teachings of which are incorporated herein by reference. The hydrocarbon fraction may be separated from the oil shale residue in any manner known in the art. The separated hydrocarbon fraction may be processed and refined in any manner known in the art including hydrotreating and hydrocracking. It is contemplated that the separated hydrocarbon fraction, regardless of intermediate processing, may make up a portion of the hydrocarbonaceous solvent required by the coal liquefaction process.

The raw oil shale may be pretreated in any manner known in the art. Thus, it is contemplated that the shale may be brought into contact with the inert gas in reactor systems such as batch, continuous, semicontinuous, tank, continuous stirred-tank, fluidized bed and the like. Preferably, the shale and inert gas are admixed at pretreatment conditions in a batch reactor.

Subsequent to pretreatment, the oil shale residue may be cooled to a temperature below 300° F. prior to admixture with the coal and hydrocarbonaceous solvent. The oil shale residue, coal, and solvent admixture may then be reacted at liquefaction conditions.

In a preferred embodiment of the present invention, the oil shale residue catalyst is separated into an organic component and residue component comprising inorganics prior to contact with the coal in the liquefaction process. The oil shale residue catalyst may be separated by any convenient method but a preferred separation technique is solvent extraction whereby the oil shale residue catalyst is separated into a soluble organic extract component and an insoluble extract residue component. In the case where the separation of the oil shale residue catalyst is conducted via solvent extraction, a preferred solvent comprises toluene. When toluene is employed as the extract solvent, the residue catalyst is separated into a toluene soluble extract component and a toluene insoluble extract residue component. If the process of the present invention utilizes an oil shale residue catalyst which has been separated as hereinabove described, it is essential that both the organic component and residue component resulting from the separation be utilized in the coal liquefaction step. In other words, regardless of separation, the entire oil shale residue comprising both organic and inorganic fractions which is prepared as hereinabove described is to be employed as the catalyst in the liquefaction process of the present invention.

Once pretreated, the oil shale residue possesses the ability to impart a catalytic effect in the conversion of coal to liquid products when coal and a hydrocarbonaceous solvent are reacted at liquefaction conditions in the presence of said oil shale residue.

Although the liquefaction process of the present invention will be described in terms of the utilization of bituminous coal, it is within the contemplated scope of the present invention that the term "coal" refers also to other coal species such as sub-bituminous coal, lignite or any other suitable coal-like materials.

The coal utilized in the present invention is preferably reduced in size compared to the pit run coarse coal. Apparatus suitable for use in pulverizing lump or coarse size coal as practiced in the process of the present invention may be of any type known to those skilled in the art. Conventional ball mills or rod mills may be used with satisfactory results. Those skilled in the art are familiar with the kind of apparatus required for processing coal and the crushing and grinding thereof so that no detailed discussion of these apparatus need be presented herein. The prime requirement for crushing and grinding of coarse lump coal is that the coarse coal is preferably processed and reduced in size to an average particle diameter equivalent to at least a −10 Tyler Screen Size. Coal fines which are available as by-product from other coal handling processes such as, for example, coal washing, are suitable for use in the process of the present invention. As used herein the term "Tyler Screen Size" refers to the commercial Tyler Standard Screens. The correlation between Tyler Screen Size and particle size can be found in most standard reference books such as *Perry's Chemical Engineer's Handbook,* Fourth Edition, pages 21–51.

Many suitable solvents may be selected to serve as the hydrocarbonaceous solvent to be utilized in the coal liquefaction process. It is preferred, however, that the solvent have the ability to transfer hydrogen to the coal during the liquefaction process. Suitable coal liquefaction solvents include, for example, benzene, toluene, xylene, naphthalene, decalin, tetralin, aromatic petroleum hydrocarbon fractions, previously recovered hydrocarbon fractions resulting from the conversion of coal or oil shale and mixtures thereof. In any event, the solvent suitable for use in the coal liquefaction must be a solvent having the capability of depolymerizing particulate coal under liquefaction conditions as herein defined, and capable of converting the coal to liquid products.

The coal liquefaction conditions in the process of the present invention include a pressure from about 500 psig to about 5000 psig, a temperature from about 450° F. to about 950° F., a residence time from about 0.1 hours to about 10 hours, a coal to oil shale residue catalyst weight ratio from about 1:1 to about 50:1 and a hydrocarbonaceous solvent to coal weight ratio from about 1:1 to about 10:1.

In one embodiment of the present invention, the coal liquefaction is preferably conducted in the presence of hydrogen and more preferably in the presence of an admixture of hydrogen and hydrogen sulfide. The coal liquefaction step of the present invention is preferably conducted in the presence of a 9:1 molar admixture of hydrogen and hydrogen sulfide, respectively.

The coal liquefaction process may be effected by any process scheme known in the art. Thus, the coal may be liquefied, for example, via batch, continuous, or fluidized bed processing. In addition, as stated earlier, the liquefaction hydrocarbonaceous solvent may comprise the hydrocarbonaceous fraction liberated from the pretreatment of the raw shale which forms the shale oil residue catalyst. It is also contemplated that a portion of liquid produced from the liquefaction process be recycled to provide at least a portion of the hydrocarbonaceous solvent in the liquefaction process.

The following examples are presented to illustrate certain preferred embodiments of this invention and are not intended as an undue limitation on the generally broad scope of the invention as set out in the appended claims.

EXAMPLE I

This example is presented for comparison purposes and illustrates a coal liquefaction process which does not use the oil shale residue catalyst as disclosed and taught by the present invention. The coal selected for this and all subsequent examples was a Southern Illinois No. 6 bituminous coal ground to a through 200 mesh screen and having the characteristics presented in the following Table I.

TABLE I

| COAL CHARACTERISTICS | |
|---|---|
| Carbon, wt. % | 60.8 |
| Hydrogen, wt. % | 5.6 |
| Nitrogen, wt. % | 1.1 |
| Sulfur, wt. % | 2.4 |
| Oxygen, wt. % | 9.0 |
| Ash, wt. % | 7.3 |
| Volatiles at 218° F., wt. % | 11.5 |

Part A

A 100 gram sample of the hereinabove described coal was soaked in 300 cc of toluene for about 12 hours. The coal and toluene admixture was charged to a rocking autoclave and the autoclave was then pressured to 100 atmospheres with hydrogen. The pressured autoclave was then heated to a temperature of 725° F. and maintained at that temperature for a period of four hours. After the heating period, the gases were vented and the autoclave was opened, scraped and washed with toluene. The effluent from the autoclave was separated into a toluene soluble and a toluene insoluble product. The toluene insoluble product weighed 24.8 grams and the toluene soluble product weighed 47.2 grams. Since 7.3 grams of ash could be expected from the coal, 17.5 (24.8 minus 7.3) grams of coal remained unconverted which represented a coal conversion of only about 80.2 wt. % (moisture-free coal).

Part B

A 100 gram sample of the Southern Illinois No. 6 coal described above was soaked in 300 cc of toluene for about 12 hours. The coal and toluene admixture was charged to a rocking autoclave and the autoclave was pressurized first with hydrogen sulfide to about 10 atmospheres and then with hydrogen to about 100 atmospheres resulting in a 9:1 overall molar admixture of hydrogen to hydrogen sulfide. The pressured autoclave was then brought to a temperature of 662° F. and maintained for a period of 4 hours. After the heating period, the gases were vented and the reaction product was removed in the same fashion as Part A. The reaction effluent was separated into a toluene insoluble product weighing 32 grams and a toluene soluble product weighing 31 grams. Since 7.3 grams of ash were expected from the coal, 24.7 (32.0 minus 7.3) grams of coal remained unconverted which represented a coal conversion of about 72.1 wt. % (moisture-free coal).

EXAMPLE II

This example illustrates the preparation of the oil shale residue catalyst of the present invention. The raw oil shale selected for this example and Examples IV and V was a Green River oil shale containing about 21 wt. % kerogen and reduced in size to a 12×20 mesh. The raw shale was then heated at 700° F. for a period of three hours in an atmosphere of hydrogen sulfide. Fifty-two grams of a light oil, 13.6 grams of gas and 9.6 grams of water were liberated in the heating process. About 625 grams of oil shale residue remained. The oil shale residue was found to have an organic fraction of about 18.4 wt. % (68 grams of toluene extractable material plus 47 grams of partially decomposed kerogen to make 115 grams total organics) and an inorganic fraction of about 81.6 wt. % (510 grams total).

EXAMPLE III

A 100 gram sample of toluene pre-soaked coal (approximately 12 hours) was mixed together with 300 cc of toluene and 50 grams of the Green River oil shale residue catalyst described in Example II. The admixture was charged to a rocking autoclave and the autoclave was then pressured to 100 atmospheres with hydrogen. The pressured autoclave was then heated to a temperature of 725° F. for a period of four hours. After the heating period, the gases were vented and the autoclave was opened, scraped and washed with toluene in the same manner as in Example I. The toluene insoluble product weighed 61.5 grams and the toluene soluble product was found to be 52.4 grams. The predicted amount of toluene insolubles would be 53.8 grams (7.3 grams of ash from coal and 46.5 grams from the shale). Therefore, 7.7 grams (61.5 minus 53.8) of unconverted coal remained which represented a coal conversion of 91.3 wt. % (moisture free). Thus, the addition of the oil shale residue catalyst in accordance with the present invention, reduced the quantity of unconverted coal from 17.5 grams (Example I) to only 7.7 grams (Example II) or in other words, increased the coal conversion from 80.2 wt. % to 91.3 wt. % (moisture-free coal).

EXAMPLE IV

This example illustrates a preferred embodiment of the present invention. The equivalent of a 50 g portion of the Green River oil shale residue catalyst described in Example II was toluene extracted to produce 46.5 grams of a toluene-insoluble extract residue component and 3.5 grams of a toluene soluble extract component. Both of the resulting components, i.e., insoluble extract residue and soluble extract were then mixed with 100 grams of toluene pre-soaked coal (approximately 12 hours) and 300 cc of toluene and charged to a rocking autoclave. The autoclave was first pressured to 10 atmospheres with hydrogen sulfide, and then with hydrogen to a final pressure of 100 atmospheres to give an overall molar ratio of hydrogen to hydrogen sulfide of 9:1. The pressured autoclave was then heated to a temperature of 725° F. for a period of four hours. After the heating period, the gases were vented and the autoclave was opened, scraped and washed with toluene in the same manner as in Examples I and III. The recovered toluene insoluble product weighed less than 53.8 grams and the toluene soluble product was found to be 67 grams. The predicted amount of toluene insolubles would be 53.8 grams (7.3 grams of ash from coal and 46.5 grams from the shale). Therefore, essentially 100% coal conversion resulted. It is to be noted that this embodiment employs a pressurization gas containing both hydrogen and hydrogen sulfide and an oil shale residue catalyst which has been separated into toluene soluble and toluene insoluble components before admixture with the coal and hydrocarbonaceous solvent (toluene). The mechanism by which these factors were able to achieve the essentially complete conversion of coal is not known for certain. Comparison to Example I, Part B, however, reveals that in the absence of the oil shale residue catalyst, use of a hydrogen/hydrogen sulfide pressurization gas yielded a lower coal conversion than when pure hydrogen was employed. It is not known whether the pressurizaton gas, method of pressurization, extraction of the residue catalyst or any combination of these factors is responsible for the superior coal conversion. It nevertheless remains that when coal liquefaction was conducted in accordance with this example, the best results were achieved.

EXAMPLE V

This example illustrates a coal liquefaction process conducted in the presence of raw oil shale. A 66.6 gram sample of the coal described in Example I was soaked in 200 cc of toluene for about 12 hours. The coal and toluene admixture and 200 grams of raw Green River oil shale were then charged to a rocking autoclave. The autoclave was pressured to a maximum of 166 atmospheres of hydrogen at a temperature of 725° F. for 4 hours. After the heating period, the gases were vented and the autoclave was opened, scraped and washed with toluene in the same manner as Examples I, III, and IV. The toluene insoluble product weighed 181.2 grams. The predicted amount of toluene insolubles was 124.9 grams (4.9 grams of ash from 66 grams of coal and 120 grams of residue from the shale). Thus, 56.3 grams of unconverted coal remained (181.2 minus 124.9) which represented a coal conversion of 15.6 percent, moisture-free coal.

Table II illustrates the coal conversion achieved in Examples I and III–V. When the oil shale residue is employed as a catalyst, a 91.3% coal conversion results (Example III). However, when raw oil shale is employed as a catalyst under similar conditions, only a 15.6% coal conversion is achieved (Example V).

TABLE II

| Example | Catalyst | Pressurization Gas | Coal Conversion, % |
|---|---|---|---|
| I, Part A | | $H_2$ | 80.2 |
| I, Part B | — | $H_2/H_2S$ | 72.1 |
| III | oil shale residue | $H_2$ | 91.3 |
| IV | toluene extracted oil shale residue catalyst | $H_2/H_2S$ | 100.0 |
| V | raw oil shale | $H_2$ | 15.6 |

The foregoing description and examples clearly illustrate the improvement in coal liquefaction encompassed by the present invention and the benefits to be afforded with the use thereof.

What is claimed:

1. A coal liquefaction process comprising reacting coal with a hydrocarbonaceous solvent at coal liquefaction conditions in the presence of an oil shale residue catalyst comprising organic and inorganic fractions, said catalyst being produced by the treatment of oil shale in the presence of an inert gas at a temperature in the range from about 500° F. to about 825° F. and at a pressure in the range of from about atmospheric to about 2000 psig for a period of time of from about 0.1 to 10 hours.

2. The process of claim 1 wherein said inert gas is selected from the group consisting of nitrogen, hydrogen sulfide, ammonia, mercaptan hydrocarbon, sulfur dioxide, carbon monoxide, carbon dioxide, water and mixtures thereof.

3. The process of claim 1 wherein said hydrocarbonaceous solvent comprises aromatic hydrocarbons.

4. The process of claim 1 wherein said hydrocarbonaceous solvent is selected from the group consisting of benzene, toluene, xylene, naphthalene, decalin, tetralin and combinations thereof.

5. The process of claim 1 wherein said hydrocarbonaceous solvent comprises a hydrocarbon fraction recovered from coal, oil shale, tar sand or petroleum crude oil.

6. The process of claim 1 wherein said coal liquefaction conditions include a pressure from about 500 psig to about 5000 psig, a temperature from about 450° F. to about 950° F., a residence time from about 0.1 hours to about 10 hours, a coal to pretreated residual oil shale weight ratio from about 1:1 to about 50:1, and a hydrocarbonaceous solvent to coal weight ratio from about 1:1 to about 10:1.

7. The process of claim 1 wherein said coal liquefaction conditions include an atmosphere comprising hydrogen and hydrogen sulfide.

8. The process of claim 1 wherein said oil shale residue catalyst is separated into an organic component and a residue component and said separated organic and residue components are then contacted with coal and a hydrocarbonaceous solvent at liquefaction conditions.

9. The process of claim 1 wherein said oil shale residue catalyst is separated into a soluble organic extract component and an insoluble extract residue component by means of solvent extraction.

10. The process of claim 9 wherein said solvent extraction is conducted with a solvent comprising toluene.

11. A coal liquefaction process comprising (a) pretreating an oil shale at pretreatment conditions sufficient to produce a hydrocarbon fraction and an oil shale residue catalyst comprising organic and inorganic fractions, said catalyst being produced by the treatment of oil shale in the presence of an inert gas at a temperature in the range from about 500° F. to about 825° F. and at a pressure in the range of from about atmospheric to about 2000 psig for a period of time of from about 0.1 to 10 hours;

(b) separating at least a portion of said hydrocarbon fraction from said oil shale residue catalyst;

(c) contacting said oil shale residue catalyst with coal and a hydrocarbonaceous solvent at coal liquefaction conditions to produce a hydrocarbonaceous liquid; and (d) recovering said hydrocarbonaceous liquid.

12. The process of claim 9 wherein said inert gas is selected from the group consisting of nitrogen, hydrogen sulfide, ammonia, mercaptan hydrocarbon, sulfur dioxide, carbon monoxide, carbon dioxide, water and mixtures thereof.

13. The process of claim 11 wherein said hydrocarbonaceous solvent comprises a hydrocarbon fraction recovered from coal, oil shale, tar sand or petroleum crude oil.

14. The process of claim 11 wherein said coal liquefaction conditions include a pressure from about 500 psig to about 5000 psig, a temperature from about 450° F. to about 950° F., a residence time from about 0.1 hours to about 10 hours, a coal to pretreated residual oil shale weight ratio from about 1:1 to about 50:1, and a hydrocarbonaceous solvent to coal weight ratio from about 1:1 to about 10:1.

15. The process of claim 11 wherein said oil shale residue catalyst is contacted with coal and a hydrocarbonaceous solvent at a temperature below 300° F. to form a reaction admixture and reacting said admixture at liquefaction conditions.

16. The process of claim 11 wherein said oil shale residue catalyst is separated into an organic component and a residue component and said separated organic and residue components are then contacted with coal and a hydrocarbonaceous solvent at liquefaction conditions.

17. A coal liquefaction process comprising reacting coal with a hydrocarbonaceous solvent comprising aromatic hydrocarbons at coal liquefaction conditions in the presence of a friable oil shale residue catalyst comprising organic and inorganic fractions which swells in the presence of the aromatic hydrocarbons, said catalyst being produced by the treatment of oil shale in the presence of an inert gas at a temperature in the range from about 500° F. to about 825° F. and at a pressure in the range of from about atmospheric to about 2000 psig for a period of time of from about 0.1 to 10 hours.

* * * * *